US007706214B2

(12) United States Patent
Scheufele

(10) Patent No.: US 7,706,214 B2
(45) Date of Patent: Apr. 27, 2010

(54) PERPETUAL CALENDAR MECHANISM

(75) Inventor: Karl-Friedrich Scheufele, Promenthoux (CH)

(73) Assignee: Chopard Manufacture SA, Fleurier (CH)

( * ) Notice: Subject to any disclaimer, the term of this patent is extended or adjusted under 35 U.S.C. 154(b) by 634 days.

(21) Appl. No.: 11/105,444

(22) Filed: Apr. 14, 2005

(65) Prior Publication Data

US 2005/0232085 A1 Oct. 20, 2005

(30) Foreign Application Priority Data

Apr. 14, 2004 (CH) ..... 0648/04

(51) Int. Cl.
*G04B 19/20* (2006.01)
*G04B 19/24* (2006.01)

(52) U.S. Cl. ..... 368/38; 368/28; 368/37

(58) Field of Classification Search ..... 368/35–38, 368/28
See application file for complete search history.

(56) References Cited

U.S. PATENT DOCUMENTS 3,710,567 A * 1/1973 Cleusix ..... 368/35
3,789,602 A * 2/1974 Nemoto ..... 368/38
4,059,953 A * 11/1977 Morrison et al. ..... 368/36
4,087,959 A * 5/1978 Laesser ..... 368/221
5,699,321 A * 12/1997 Vaucher ..... 368/37
6,108,278 A * 8/2000 Rochat ..... 368/28
6,744,696 B2 * 6/2004 Vernay et al. ..... 368/37
2003/0151981 A1 * 8/2003 Vernay et al. ..... 368/37
2003/0193840 A1 * 10/2003 Huter ..... 368/37
2006/0221773 A1 * 10/2006 Kuepfer et al. ..... 368/37

FOREIGN PATENT DOCUMENTS

WO WO 2004/066039 * 5/2004

* cited by examiner

*Primary Examiner*—Vit W Miska
*Assistant Examiner*—Sean Kayes
(74) *Attorney, Agent, or Firm*—Young & Thompson

(57) ABSTRACT

The perpetual calendar mechanism includes a date mobile (16, 28-31), a date lever (3) bearing a small click (14), a correction lever (4) driving a great click (40) and a finger (2) driving the levers (3, 4). The date mobile (16, 28-31) is shifted instantaneously by the small click (14) during the transition from one day to the next within a month and during the transition from the last day of a month of 31 days to the first day of the following month, and partly in a dragging manner by the great click (40) during the transition from the last day of a month of less than 31 days to the first day of the following month.

12 Claims, 9 Drawing Sheets

PERPETUAL CALENDAR MECHANISM

The present invention concerns a perpetual or annual calendar mechanism for a timepiece such as a wristwatch.

The perpetual or annual calendar mechanisms generally comprise a driving lever bearing a small click cooperating with a 31-tooth date wheel of a date mobile for the transition from one day to the next within a month and for the transition from the last day of a month of 31 days to the first day of the following month, and a great click cooperating with a snail correction cam of the date mobile for the correction of the last days of months of less than 31 days.

In some of these mechanisms, the driving of the date mobile by the small and great clicks during each transition from one day to the next is dragging, that is to say that it's effected in a slow manner, generally over several hours. During this time, the date of the current day progressively gives way to the date of the next day in the date display window provided in the dial of the watch. This solution is not really satisfactory, because it is prejudicial to the display accuracy and to the aesthetic of the watch.

In other mechanisms, the driving of the date mobile by the small and great clicks during each transition from one day to the next is instantaneous. The date display on the dial therefore changes instantaneously at midnight, which is appreciable. However, here, a non negligible risk exists that at the end of the transition from the last day of a month of less than 31 days to the first day of the following month, the date mobile pursues its movement due to its inertia, therefore causing an erroneous display of the date. This risk is particularly present during the transition from the 28th of Feb. to the 1st of Mar. when the date mobile has to complete a four pitch jump in an instantaneous manner.

The present invention aims to remedy the aforementioned drawbacks of the known perpetual or annual calendar mechanisms, or at least to alleviate them, and provides for this purpose a calendar mechanism according to the appended claim 1, particular embodiments being defined in the dependent claims.

Other features and advantages of the invention will appear from the reading of the following detailed description in conjunction with the annexed drawings, in which.

Figure 1:
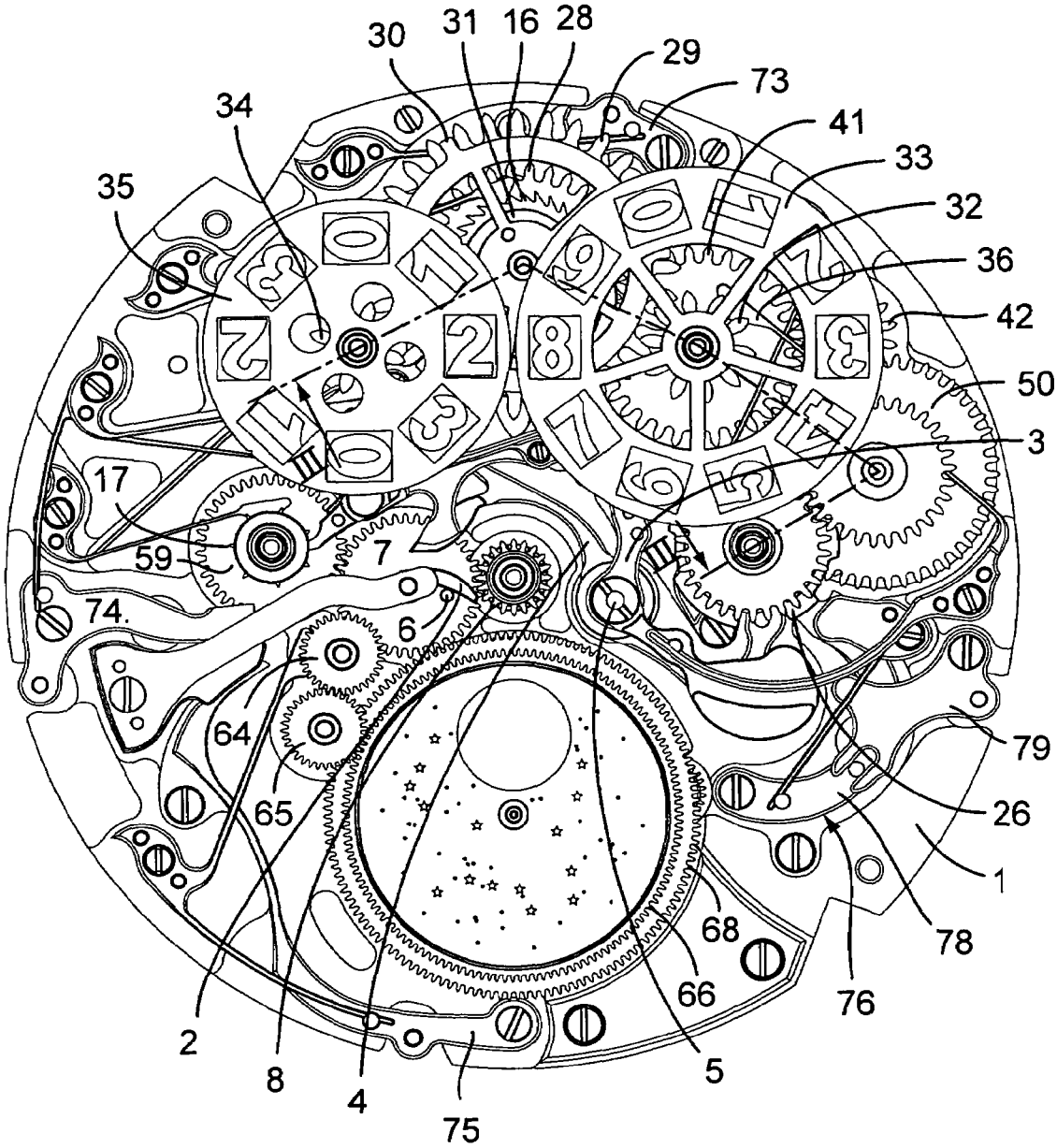
FIG. 1 is a top view (from the dial of the watch) of a perpetual calendar mechanism according to the invention, indexed at the 28th of Feb.

With reference to FIGS. 1 to 5, the perpetual calendar mechanism according to the invention is mounted on a plate 1 intended to be located in a watch case between the movement and the dial.

This mechanism comprises in particular a date finger 2, a date lever 3 and a correction lever 4. The levers 3, 4 are mounted about a same pivot axis 5, but are free to rotate one relatively to the other.

The date finger 2 is continuously driven counter-clockwise at one revolution per day by a pin 6 solid with a 24-hour wheel 7 meshing with a 12-hour intermediate wheel 8 solid with the hours wheel of the watch. The date finger 2 cooperates each day, from a given time, with a finger 9 (cf. FIG. 4) of the date lever 3 and a finger 10 (cf. FIG. 5) of the correction lever 4, to progressively lift these two levers 3, 4 against the action exerted on the date lever 3, respectively on a pivoting shuttle 11 cooperating with the correction lever 4, by respective return springs 12, 13.

Figure 6:
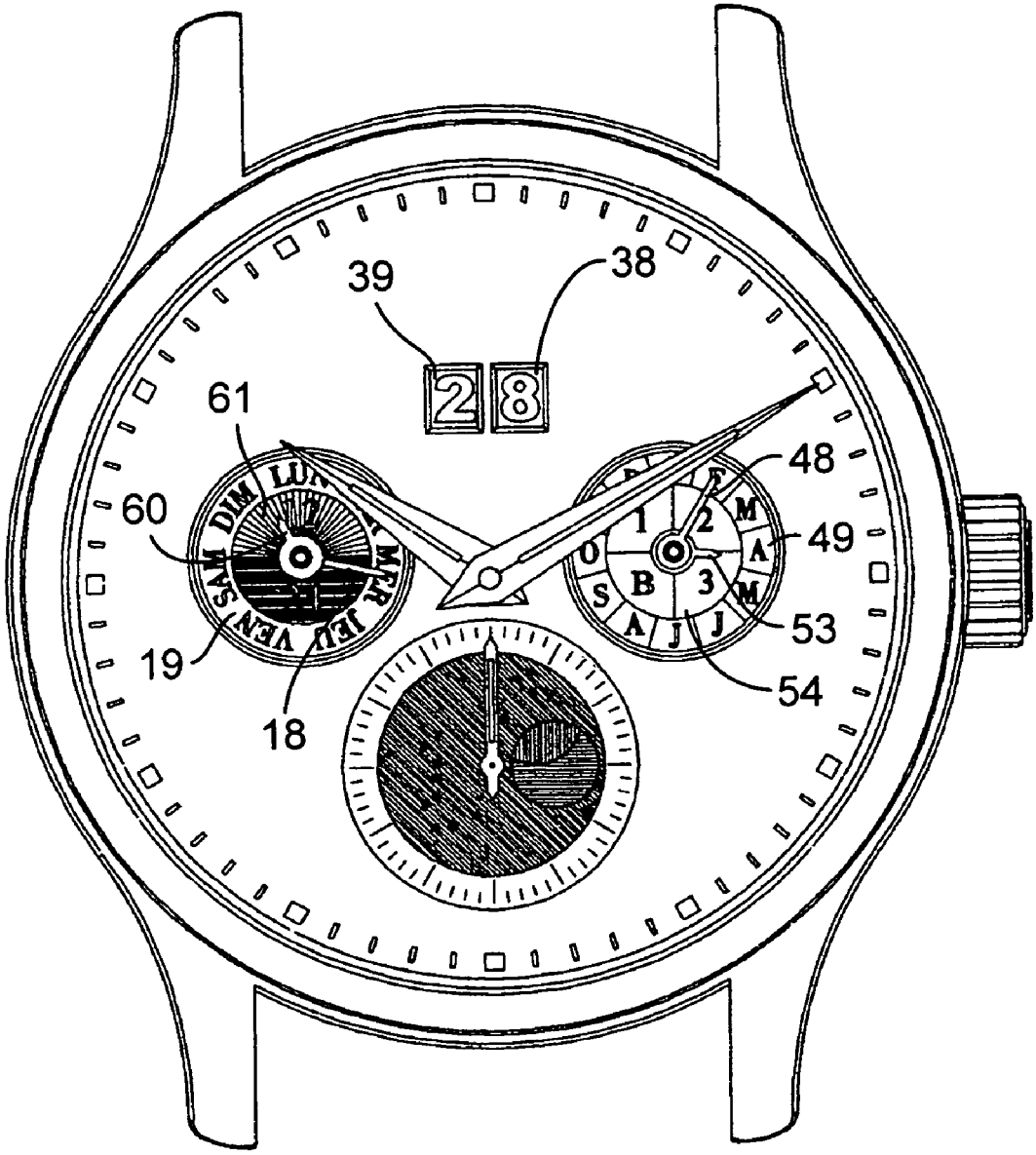
FIG. 6 is a top view of a watch including the perpetual calendar mechanism according to the invention.

The date lever 3 comprises, in addition to finger 9, a first small click 14 and a second small click 15 which, during the transition from one day to the next, cooperate respectively with a 31-tooth date star-wheel 16 and a seven-tooth days star-wheel 17 to make them rotate instantaneously by one pitch. The days star-wheel 17 bears a display hand 18 associated with a weekdays display area 19 on the dial of the watch (FIG. 6). The angular position of the date star-wheel 16 and that of the days star-wheel 17 are indexed by jumpers 20, 21, respectively.

Figure 5:
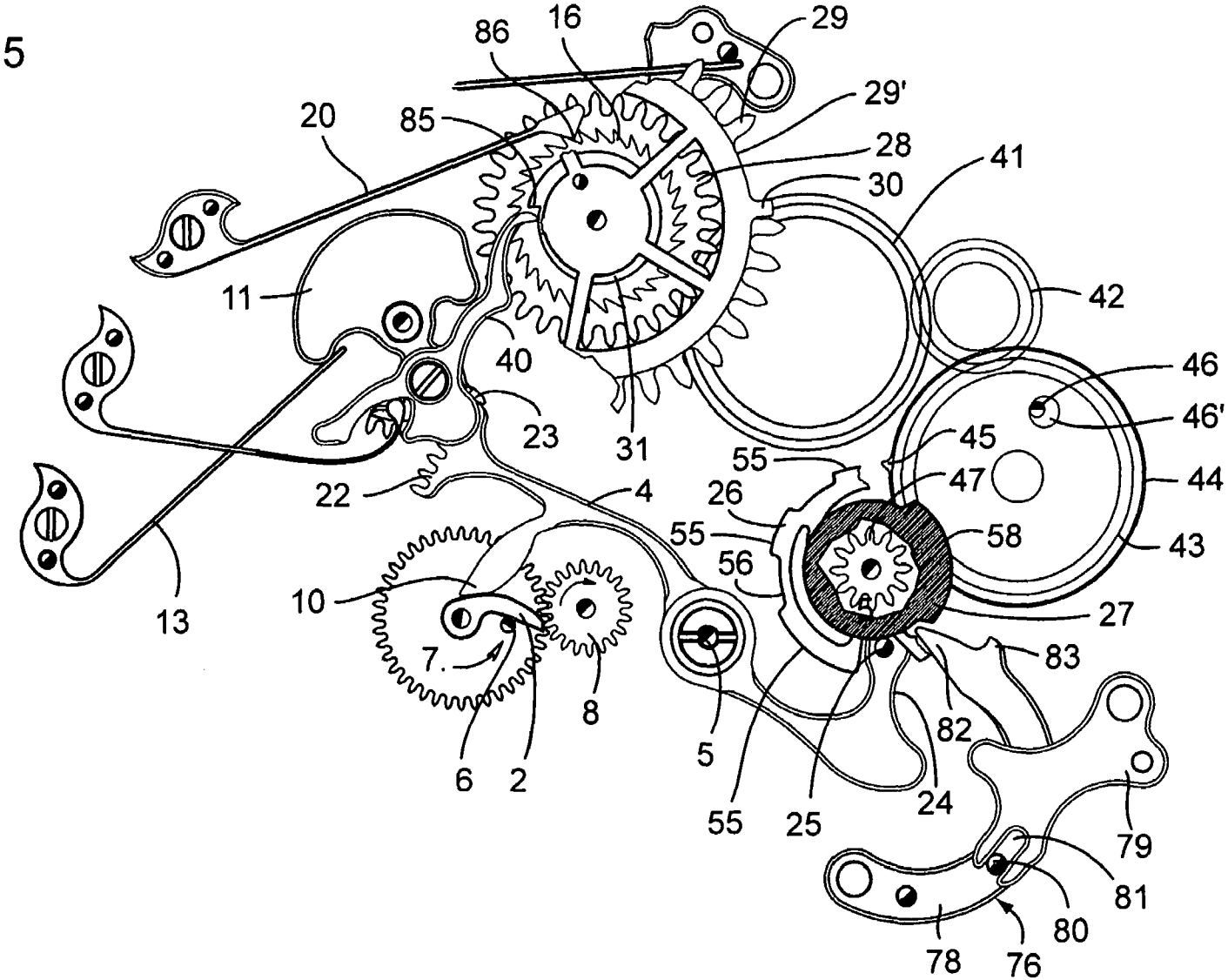
FIG. 5 is a partial top view of the perpetual calendar mechanism according to the invention, showing the portions corresponding to the function of correction (overtaking) of the days of the end of a month of less than 31 days.

The correction lever 4 comprises at one of its ends a rack 22 engaged with a corresponding rack 23 of the pivoting shuttle 11, and at another end a feeler consisting of a finger 24 in which a feeler pin 25 is secured, the feeler pin 25 being, in rest position of the correction lever 4, in contact with a months cam 26 or a leap year cam 27 (FIG. 5).

Each lever 3, 4 extends partly on one side of the pivot axis 5 and partly on the other side of the pivot axis 5. It should be particularly noted, concerning the correction lever 4, that the feeler 24-25 is located on the side opposite to the one of the rack 22 and the finger 10. The shape of each lever 3, 4 is chosen advantageously so that the centre of gravity of the lever 3, 4 be substantially on the pivot axis 5. In this way, the mechanism becomes less sensitive to impacts. Moreover, one or several ball bearings can be associated with the pivot axis 5 of levers 3, 4 to reduce the friction coefficients.

The date star-wheel 16 is solid with a 31-tooth date wheel 28, a units wheel 29 having 29 teeth plus an empty space 29' taking up the space of two consecutive teeth, a four-tooth tens wheel 30 and a snail correction cam 31. The assembly formed by the date star-wheel 16, the date wheel 28, the units wheel 29, the tens wheel 30 and the correction cam 31 will be referred to as "date mobile" in the following of this description.

The units wheel 29 is engaged with a ten-tooth units pinion 32 bearing a units disk 33 on which there is displayed a sequence of digits 0 to 9 of great size representing the units of the date. The tens wheel 30 cooperates with an eight-tooth tens pinion 34 bearing a tens disk 35 on which are displayed two consecutive sequences of digits 0 to 3 of great size representing the tens of the date. The pinions 32, 34 are each subject to the action of a jumper 36, 37, respectively. The units and tens disks 33, 35 are juxtaposed, and allow the display of the date in two respective large windows 38, 39 provided in the dial of the watch (FIG. 6).

Figure 7:
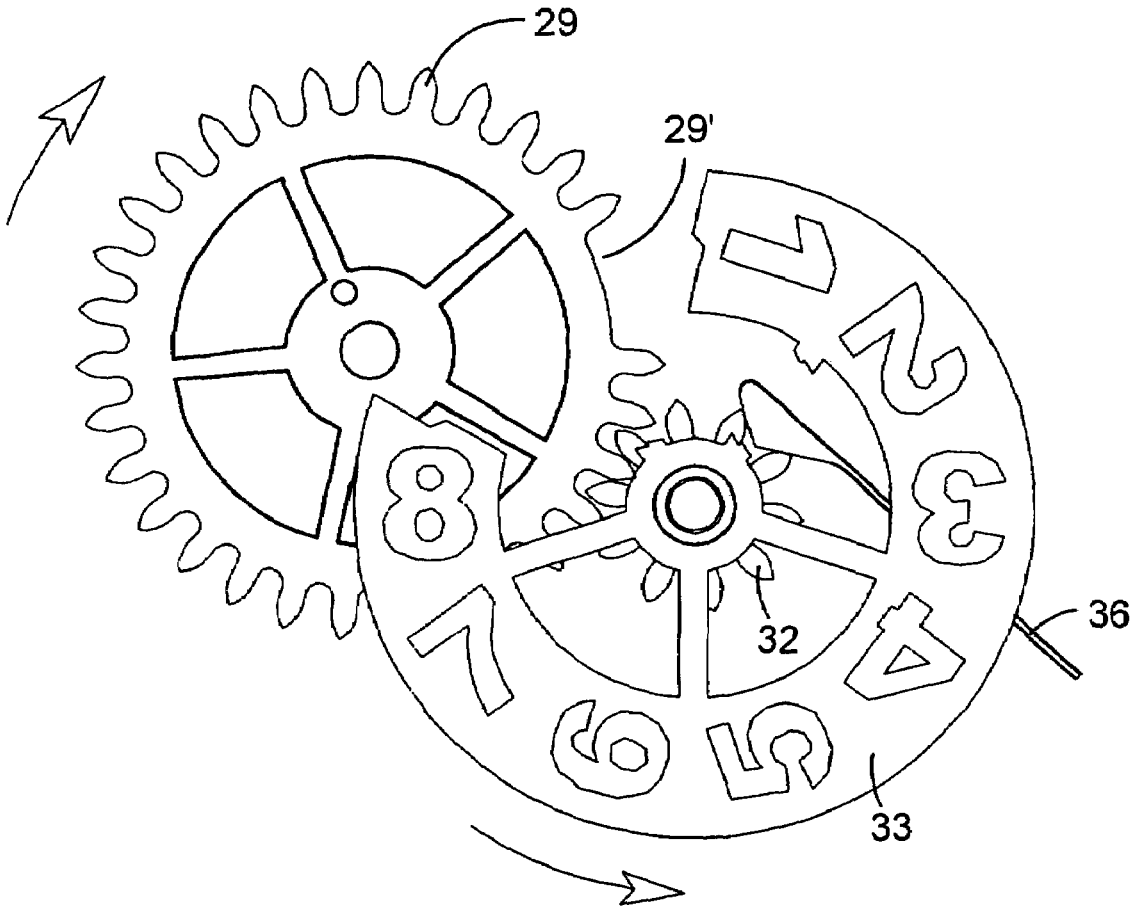
FIG. 7 is a top view showing portions of the perpetual calendar mechanism according to the invention corresponding to the function of displaying the date units.
Figure 8:
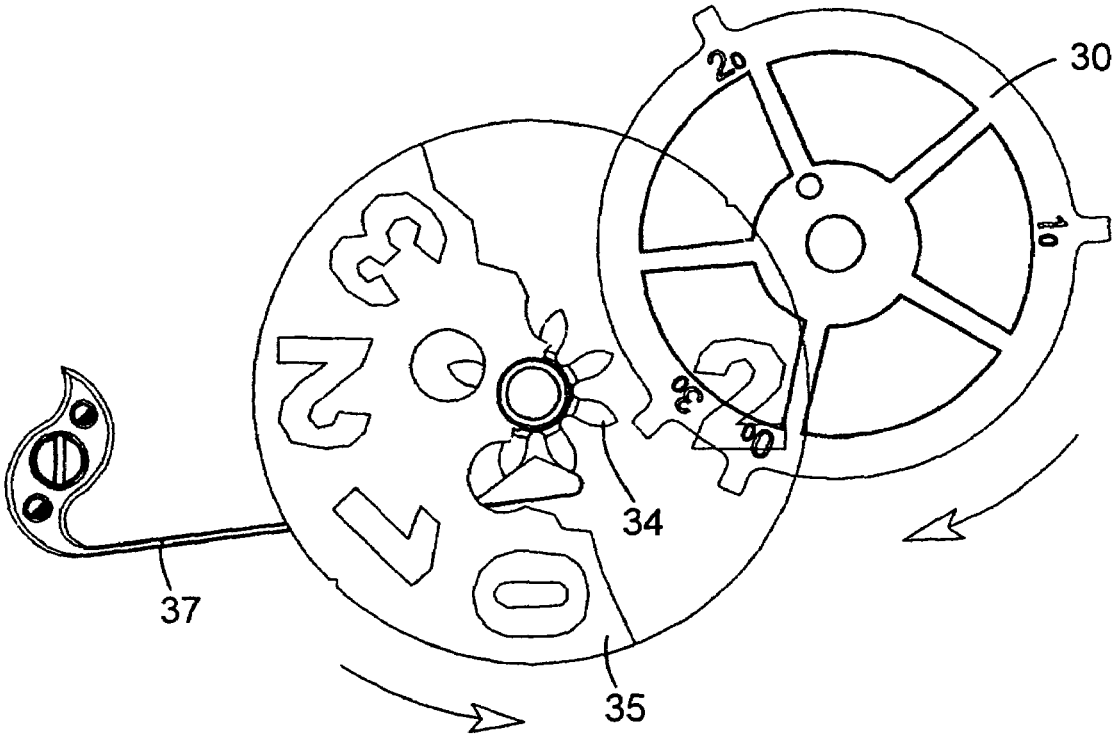
FIG. 8 is a top view showing portions of the perpetual calendar mechanism according to the invention corresponding to the function of displaying the date tens.

The gear formed by the units wheel 29 and the units pinion 32 is shown in detail on FIG. 7. As described, the teeth of the wheel 29 and of the pinion 32 have an epicycloidal shape, and each tooth of the wheel 29, when aligned along the imaginary line passing through the respective centres of the wheel 29 and of the pinion 32, is centred between teeth of the pinion 32, and reciprocally. This toothing arrangement of the units wheel 29 and of the units pinion 32 enables both the depth of penetration of these toothings to be increased and the date mobile 16, 28-31 to be locked in its angular position with respect to the units pinion 32 owing to the fact that at every moment, except when the date mobile 16, 28-31 is in an angular position corresponding to the 31st or to the 1st, a tooth of the units wheel 29 is located between two teeth of the pinion 32. When the date mobile 16, 28-31 is in an angular position corresponding to the 31 st or to the 1 st, the toothing of the units pinion 32 is facing the empty space 29'. In this position, the date mobile 16, 28-31 is blocked in a direction by a tooth of the units pinion 32 close to a tooth of the units wheel 29, and in the other direction by a tooth of the tens pinion 34 close to a tooth of the tens wheel 30.

The shuttle 11 (FIGS. 2 and 5) is pivotably mounted about the same axis as the tens pinion 34 and the tens disk 35, but is free to rotate with respect to this pinion 34 and this disk 35. A great click 40 articulated to the shuttle 11 cooperates with the correction cam 31 to shift in a dragging manner the date mobile 16, 28-31 by one or several pitches depending on the angular position of the months cam 26 or of the leap year cam 27 detected by the feeler 24-25 of the correction lever 4 during the transition from the last day of a month of less than 31 days to the first day of the following month.

Figure 2:
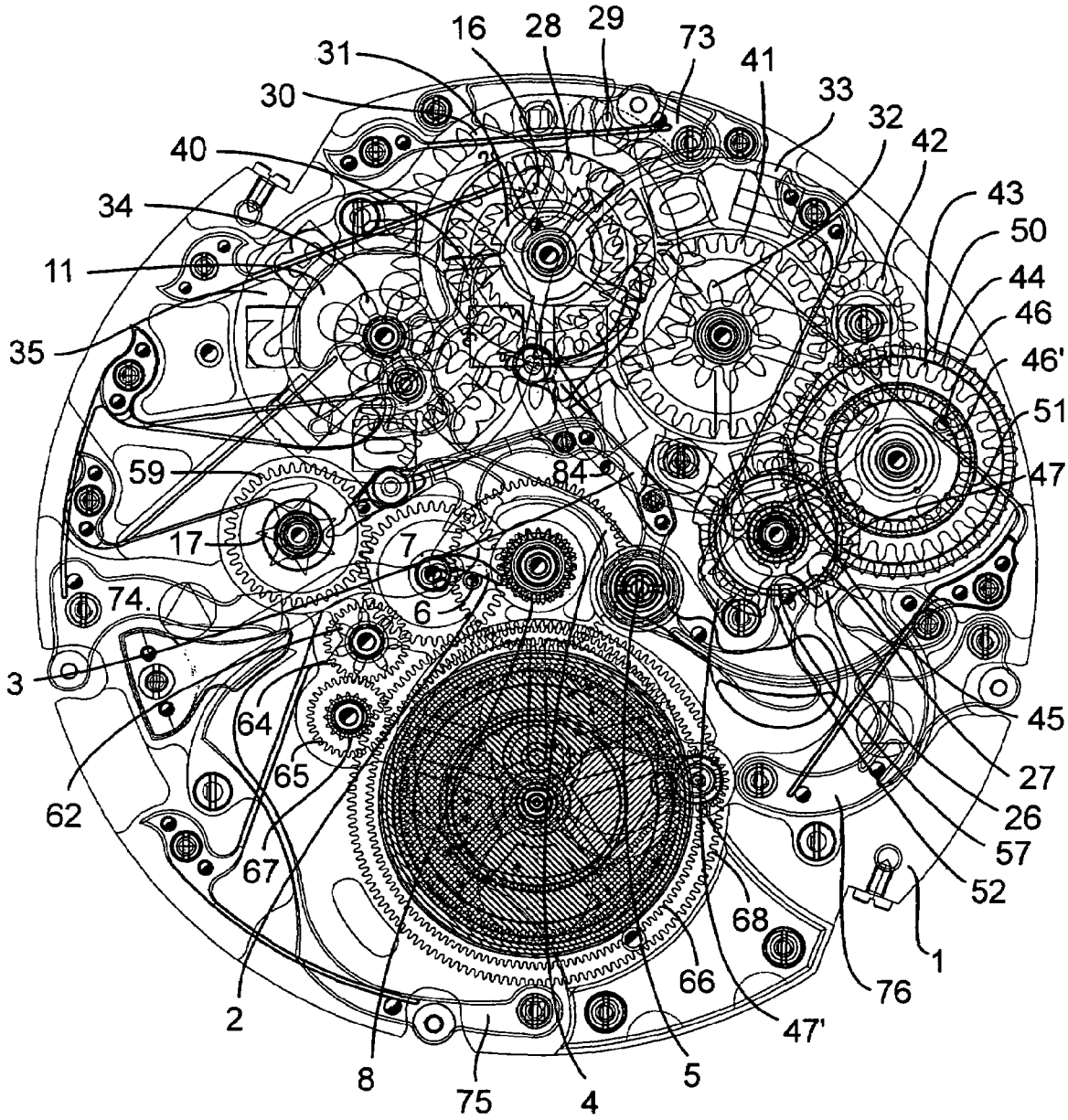
FIG. 2 is a top view of the perpetual calendar mechanism according to the invention, but in which all the parts of the mechanism will be assumed to be transparent.
Figure 3:
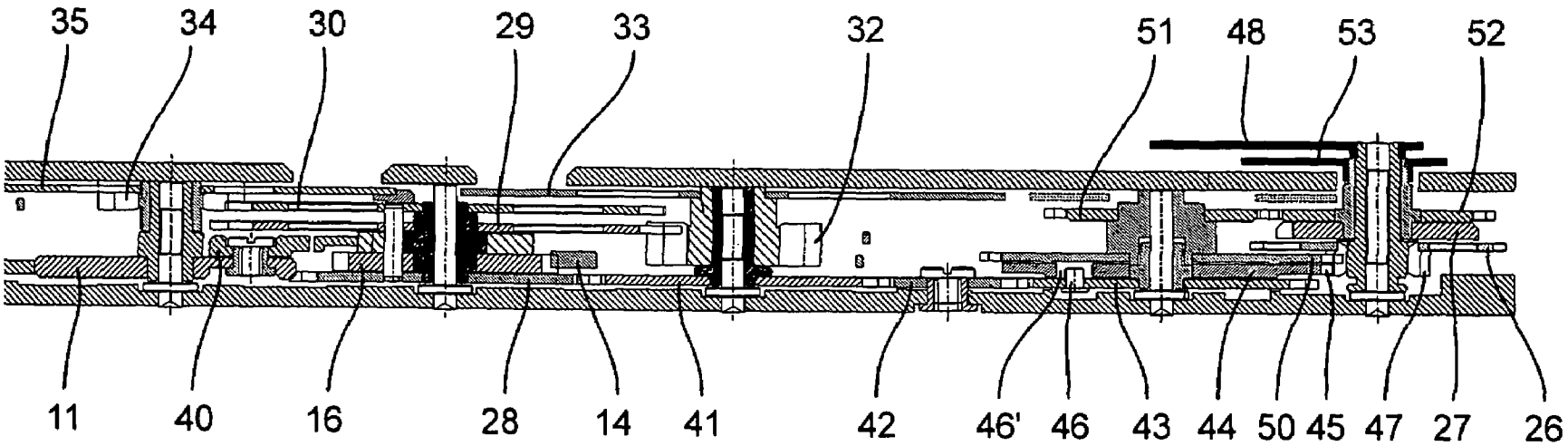
FIG. 3 is a sectional view of the perpetual calendar mechanism according to the invention, taken along the broken line III-III of FIG. 1.
Figure 4:
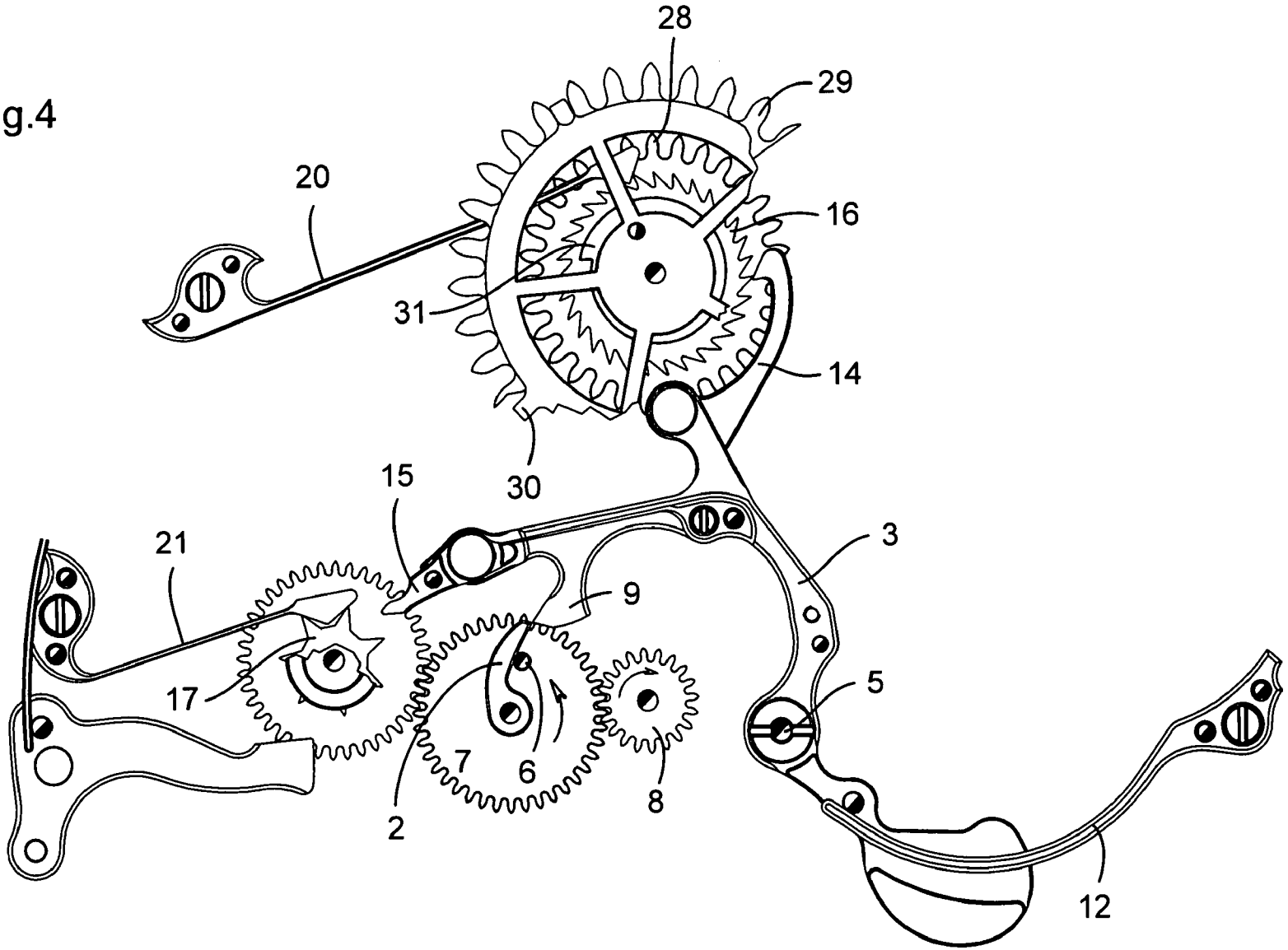
FIG. 4 is a partial top view of the perpetual calendar mechanism according to the invention, showing the portions corresponding to the dates and days function of the mechanism.

The date wheel 28 is engaged with a 31-tooth intermediate date wheel 41 mounted about the same axis as the units pinion 32 and the units disk 33, but free to rotate with respect to this pinion 32 and this disk 33 (FIGS. 1, 2, 3). The intermediate date wheel 41 meshes with an intermediate pinion 42 which itself meshes with a 31-tooth months wheel 43. This months wheel 43 drives a months disk 44 coaxial with the months wheel 43 and comprising a finger 45 on its periphery, through a pin 46 solid with the wheel 43 and located in a hole 46' of the months disk 44 larger than itself (FIGS. 2, 3, 5).

The finger 45 of the months disk 44 cooperates at the end of each month with a 12-tooth months pinion 47 to drive it by one pitch, so that it makes one revolution per year. This months pinion 47, with which the months cam 26 is solid, bears a month display hand 48 associated with a month display area 49 on the dial of the watch (FIGS. 3, 6) and is subject to the action of a jumper 47' (visible on FIG. 2).

The months pinion 47 drives a 48-month wheel 50, with 48 teeth, mounted about the same axis as the months wheel 43 and the months disk 44, but free to rotate with respect to the same, to drive it at the rate of one revolution in four years. A first 30-tooth year wheel 51 is solid with the 48-month wheel 50. A second 30-tooth year wheel 52 mounted about the same axis as the months pinion 47, but free to rotate with respect to this pinion 47, is driven by the first year wheel 51. This second year wheel 52, with which the leap year cam 27 is solid, bears a leap year display hand 53 associated with a corresponding display area 54 on the dial of the watch.

The months cam 26 has a periphery the radius of which is variable and depends upon the number of days of the months of the year, the angular position of this cam 26 defining the current month. The periphery of the cam 26 comprises, more precisely, (cf. FIG. 5) great radius portions 55, corresponding to months of 31 days, intermediate radius portions 56, corresponding to months of 30 days, and a small radius portion 57 (visible on FIG. 2), corresponding to the month of February of a non leap year (28 days). The leap year cam 27 has on its periphery a unique bump 58 (FIG. 5) associated with the month of February of leap years. The bump 58 of the leap year cam 27 has, during the month of February of each leap year, an angular position in which the angular sector defined by the bump 58 includes the one defined by the lower part 57 of the periphery of the months cam 26 and, during the month of February of each non leap year, an angular position in which the aforementioned angular sectors are separated.

With additional reference to FIGS. 1 and 2, the 24-hour wheel 7 bearing the pin 6 for driving the date finger 2 meshes with a second 24-hour wheel 59 mounted about the same axis as the days star-wheel 17, but free to rotate with respect to this days star-wheel 17. This second 24-hour wheel 59 bears a day/night display hand 60 associated with a corresponding day/night display area 61 on the dial of the watch, concentric with the weekdays display area 19 (FIG. 6).

Figure 9A:
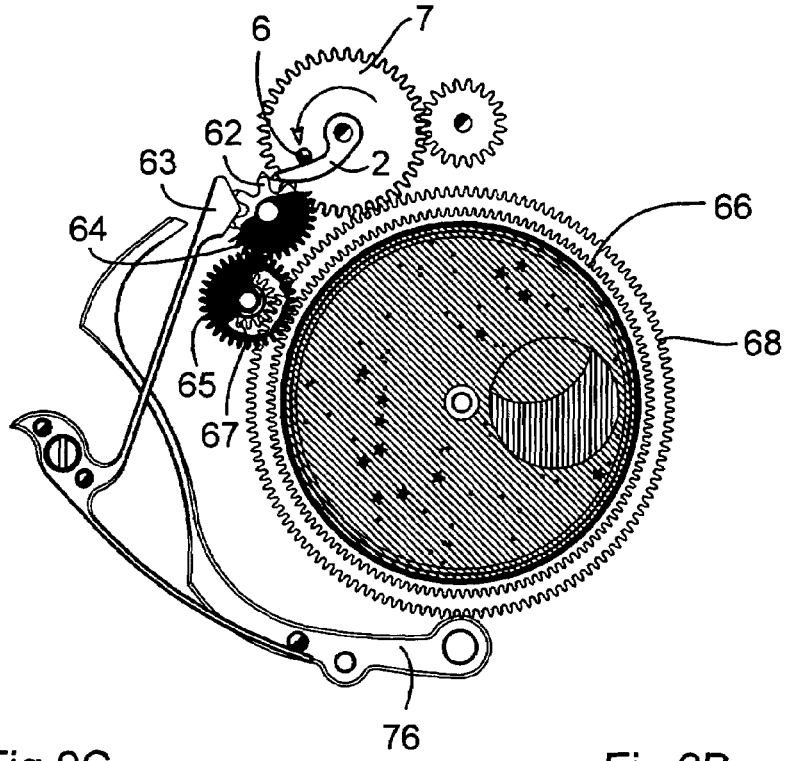
FIGS. 9A, 9B, 9C are top views showing portions of the perpetual calendar mechanism according to the invention corresponding to the function of displaying the moon phase.
Figure 9C:
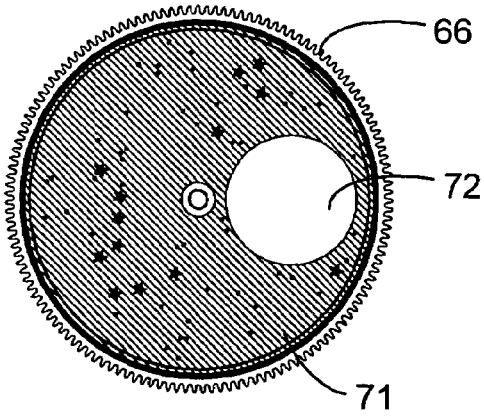
Figure 9B:
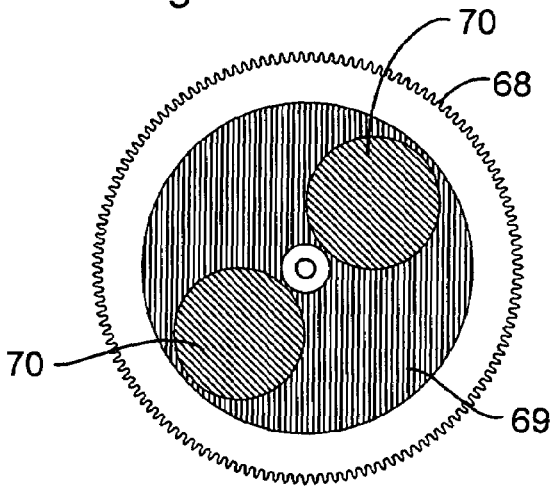

The perpetual calendar mechanism according to the invention also comprises a moon phase display device. This device comprises (cf. FIGS. 1, 2, 9A) a moon pinion 62 driven by the date finger 2 at one pitch per day and subject to the action of a jumper 63. The moon pinion 62 bears an intermediate pinion 64 which meshes with a second intermediate pinion 65 itself meshing with a window wheel 66. A third intermediate pinion 67 is solid with the second intermediate pinion 65, and meshes with a moon wheel 68. The meshing ratios between the first and second intermediate pinions 64, 65, between the second intermediate pinion 65 and the window wheel 66 and between the third intermediate pinion 67 and the moon wheel 68 are such that the window wheel 66 is driven step by step at one pitch per day and one revolution per moon revolution (29 days, 12 hours and 45 minutes), and that the moon wheel 68 is driven step by step at an angular speed half as high than that of the window wheel 66. The moon wheel 68 defines a disk 69 comprising two pellets 70 diametrically opposed having the colour blue of the sky, the rest of the disk 69 having the colour yellow of the moon (FIG. 9B). The window wheel 66, located above the moon wheel 68, defines a disk 71 with the colour blue of the sky and comprising a circular window 72 of same diameter as the pellets 70 (FIG. 9C). In this device, the full moon appears through the window 72 when the latter is in the six o'clock position and is between the two pellets 70. The new moon appears when the window 72 and one of the two pellets 70 are at noon. From this noon position, the user will see the moon increase day after day in the right portion of the wheels 66, 68 until full moon, and then decrease in the left portion of the wheels 66, 68. This moon phase display device is known in itself. It was described by Mr Philip Barat in his Diploma thesis at the Ecole d'Ingénieurs de Genéve (School of Engineering of Geneva) in June 1983.

The perpetual calendar mechanism according to the invention further comprises correctors 73, 74, 75, 76 allowing manual correction of the angular position, respectively, of the date mobile 16, 28-31, of the days star-wheel 17, of the moon pinion 62 and of the months pinion 47. These correctors 73-76 are operated by push-buttons (not represented) projecting from the edge of the watch. Each corrector 73-75 is a mere pivoting member arranged to push a tooth of the date wheel 28, of the days star-wheel 17 and of the moon pinion 62, respectively. The corrector 76 associated with the months pinion 47 comprises (cf. FIG. 5) two pivoting parts 78, 79 having different pivot axes. The part 78 bears a pin 80 cooperating with a slot 81 of the part 79 and further comprises a finger 82 capable of lifting the correction lever 4 when the latter is in contact with the months cam 26 or the leap year cam 27 and a beak 83 capable of pushing a tooth of the months pinion 47 after the finger 82 has lifted the correction lever 4 to shift the months pinion 47 clockwise by one pitch.

The perpetual calendar mechanism according to the invention operates in the following manner.

In rest position, the date lever 3 is maintained by its return spring 12 against an abutment 84 (visible on FIG. 2) and the correction lever 4 is maintained by the return spring 13 acting on the shuttle 11 in a position where the feeler pin 25 is resting against the periphery of the months cam 26 or the leap year cam 27. More precisely, in this rest position, the feeler pin 25 is in contact with an upper part 55 or an intermediate part 56 of the periphery of the months cam 26 when the current month has 31 days or 30 days, respectively, with the portion of the periphery of the leap year cam 27 other than the bump 58 in the recess corresponding to the lower part 57 of the months cam 26 when the current month has 28 days, or with the bump 58 of the leap year cam 27 when the current month has 29 days. Thus, the angular position of the correction lever 4 in this rest position is different depending on the periphery portion of the months cam 26 or the leap year cam 27 that the feeler pin 25 touches, in other words depending on the current month. Each day, from a given time, between about 6 p.m. and 9 p.m., the date finger 2 comes into contact with the finger 10 of the correction lever 4 and begins to progressively lift this lever 4 against the action exerted by the return spring 13, thus moving the feeler pin 25 away from the months cam 26 and the leap year cam 27. The time at which the date finger 2 comes into contact with the finger 10 depends on the aforementioned angular position of the correction lever 4 in its rest position, and therefore on the number of days of the current month. The longer the current month is, the more this time will be late and therefore the less the amplitude of displacement of the correction lever 4 under the action of the date finger 2 will be great.

During the lifting of the correction lever 4, the rack 22 drives the shuttle 11 in rotation, which causes the free end of the great click 40 to slide on the peripheral surface of the correction cam 31. During the days other than the last day of a month of less than 31 days, this sliding of the free end of the great click 40 has no effect on the angular position of the date mobile 16, 28-31. On the other hand, on the last day of a month of 30 days, 29 days or 28 days, the free end of the great click 40 comes into contact with the setback, designated on FIG. 5 by reference 85, of the correction cam 31, and begins to push this cam 31 to shift the date mobile 16, 28-31 clockwise respectively by one pitch, two pitches or three pitches so that the date mobile 16, 28-31 reaches an angular position corresponding to the date 31. Next, the correction lever 4 is released from the action of the date finger 2, and the return spring 13 makes it drop so that it retrieves its rest position. Because the great click 40 cooperates with the correction cam 31 during the progressive lifting of the correction lever 4, the shift of the date mobile 16, 28-31 by the great click 40 is dragging. More precisely, each shift by one pitch of the date mobile 16, 28-31 by the great click 40 comprises a first, slow movement, during which the great click 40 pushes the correction cam 31 against the action exerted by the jumper 20 until the apex of a tooth of the date star-wheel 16 in contact with the jumper 20 reaches the tip of the latter, designated by 86, and a second, fast movement, initiated by the drop of the jumper 20 on the other side of said tooth and from which the great click 40 loses momentarily contact with the setback 85.

During the lifting of the correction lever 4, the date finger 2 comes into contact with the finger 9 of the date lever 3, thus causing a progressive lifting of this lever 3 against the action exerted by the return spring 12. The end of the lifting of the date lever 3 occurs after the end of the lifting of the correction lever 4, but before the drop of the correction lever 4. As soon as the date finger 2 releases the date lever 3, this lever 3 drops under the action of the return spring 12 to retrieve its rest position. During this drop, the first small click 14 catches a tooth of the date star-wheel 16 to shift angularly and instantaneously this star-wheel 16 and therefore the date mobile 16, 28-31 by one pitch. During this same drop of the date lever 3, the second small click 15 catches a tooth of the days star-wheel 17 to shift angularly and instantaneously this star-wheel 17 and therefore the weekday display hand 18 by one pitch to display the following day.

This instantaneous shift by one pitch of the date mobile 16, 28-31 and of the days star-wheel 17 by the small clicks 14, 15 occurs each day, let it be or not the end of a month of less than 31 days. If the current day is the last day of a month of less than 31 days, this instantaneous shift by one pitch of the date mobile 16, 28-31 will follow the dragging shift of this mobile by the great click 40 to end the transition from the last day of the current month to the first day of the following month. In all the other circumstances, i.e for the transition of one day to the next within a month or the transition from the last day of a month of 31 days to the first day of the following month, the great click 40 has no function, and the instantaneous shift by one pitch of the date mobile 16, 28-31 by the small click 14 is the sole shift undergone by the date mobile 16, 28-31.

When the date mobile 16, 28-31 is rotated by one pitch, let it be by the small click 14 in an instantaneous manner or by the great click 40 in a dragging manner, the units wheel 29 of the date mobile 16, 28-31 shifts by one pitch the units pinion 32 so as to change the date unit displayed in the window 38 to the next unit, except once a month, when the date mobile 16, 28-31 is in an angular position corresponding to the date 31. In this position, indeed, the toothing of the units pinion 32 is facing the empty space 29' of the toothing of the units wheel 29 and, therefore, is not driven. When the date mobile 16, 28-31 changes from the angular position corresponding to the 31st to the one corresponding to the 1st, the units disk 33 therefore remains still and the digit 1 of the units remains displayed through the window 38.

The tens pinion 34 is driven by the tens wheel 30 of the date mobile 16, 28-31 only four times a month, corresponding to the changes of the ten of the date, when the toothing of the tens pinion 34 is in the path of one of the four teeth of the tens wheel 30. Each time the tens pinion 34 is shifted by one pitch, the tens disk 35, solid with the pinion 34, also shifts so as to display the next ten of the date in the window 39.

Moreover, each rotation by one pitch of the date mobile 16, 28-31 entails, via the intermediate date wheel 41 and the intermediate pinion 42, a rotation by one pitch of the months wheel 43 and of the months disk 44. This rotation by one pitch of the wheel 43 and the disk 44 however causes the finger 45 of the months disk 44 to rotate the months pinion 47 only when the date mobile 16, 28-31 changes from an angular position corresponding to the 31st to an angular position corresponding to the 1st, the rest of the time the finger 45 being outside the toothing of the months pinion 47. Each rotation by one pitch of the months pinion 47 causes the months cam 26 and the month display hand 48 located above the months display area 49 on the dial of the watch to be rotated by one pitch for the transition to the following month. Each rotation by one pitch of the months pinion 47 also causes a rotation by one pitch of the 48-month wheel 50 which itself causes, through year wheels 51, 52, a rotation by one pitch of the leap year cam 27 and of the leap year display hand 53 associated with the display area 54 on the dial of the watch.

The fingers 9, 10 of the levers 3, 4 are designed so that the drop of the date lever 3 always occurs before the drop of the correction lever 4. Thus, the instantaneous shift by one pitch that the date mobile 16, 28-31 makes every day during the drop of the date lever 3, which shift, as explained above, causes a shift of the months pinion 47 and of the months cam 27 at each end of a month, occurs while the feeler 24-25 of the correction lever 4 is apart from the peripheral surface of the cams 26, 27. In this way, a blocking of the mechanism is prevented.

At any time during the operation of the mechanism, the angular position of the date mobile 16, 28-31, of the days star-wheel 17, of the moon pinion 62 and of the months pinion 47 can be corrected manually through the correctors 73-76, respectively, and this without a blocking risk. Regarding more particularly the months pinion 47, it is to be noted that rotation of this pinion 47 by the corrector 76 has never any effect on the angular position of the date mobile 16, 28-31. Indeed, when this rotation occurs while the finger 45 is outside the toothing of the months pinion 47, the months disk 44 cannot be driven by the months pinion 47. When the rotation of the months pinion 47 occurs while the finger 45 is within the toothing of said pinion 47, the months disk 44 is driven by one pitch counter-clockwise, but as the hole 46' is greater than the pin 46 it receives, the months wheel 43 remains still, therefore also leaving the date mobile 16, 28-31 still.

The present invention as described above presents several advantages in addition to those already mentioned. One of them is that the change-of-date display is effected instantaneously most of the time, i.e. during the transition from one day to the next within a month and during the transition from the last day of a month of 31 days to the first day of the following month, but with a reduced risk of the date mobile 16, 28-31 being driven by its inertia into a non desired shift, this due to the fact that the shift of the date mobile 16, 28-31 during the transition from the last day of a month of less than 31 days to the first day of the following month is partly effected in a dragging manner. More particularly, it will be noted that, in the illustrated example, the instantaneous shifts of the date mobile 16, 28-31 are always restricted to a single pitch.

Another advantage of the invention is that it allows, by the presence of the two levers 3, 4 bearing respectively the small click 14 and the great click 40, the creation of a sufficient shifting angle for the clicks 14, 40 while freeing some space for another display device, i.e., in the illustrated example, the moon phase display device 62-68, and while allowing a great-size display of the date by two juxtaposed disks 33, 35. In a general manner, it will be noted that the mechanism according to the invention allows for a user-friendly layout of different display areas well readable on the dial of the watch.

The present invention has been described above only by way of example. It goes without saying that modifications can be made without deviating from the scope of the invention. For example, the mechanism could be made merely annual by removing the leap year cam 27 and the gears associated with it. Another modification could consist in removing the moon phase display device 62-68 or in replacing it by a tourbillon, for example.

The invention claimed is:

1. A perpetual or annual calendar mechanism comprising:

a date mobile (16, 28-31); and means (2, 3, 4, 14, 40) for driving the date mobile, wherein the driving means are arranged so that, during the transition from one day to the next within a month, the date mobile is shifted in an instantaneous manner, and during the transition from the last day of a month of less than 31 days to the first day of the following month, the date mobile is shifted in a dragging manner until it reaches an angular position corresponding to the $31^{st}$ and then in an instantaneous manner to pass from the $31^{st}$ to the $1^{st}$, said instantaneous shifts of the date mobile being effected by a first driving member of said driving means dropping under the action of a first return spring, said dragging shift of the date mobile being effected by a second driving member of said driving means progressively moving against the action of a second return spring.

2. The calendar mechanism according to claim 1, wherein the driving means (2, 3, 4, 14, 40) are arranged so as to shift the date mobile (16, 28-31) in an instantaneous manner during the transition from the last day of a month of 31 days to the first day of the following month, said instantaneous shift of the date mobile being effected by said first driving member dropping under the action of said first return spring.

3. The calendar mechanism according to claim 1, wherein the driving means (2, 3, 4, 14, 40) comprise a first lever (3) bearing a first click (14) constituting said first driving member and cooperating with a date wheel (16) of the date mobile (16, 28-31) to shift the date mobile (16, 28-31) in said instantaneous manner during the transition from one day to the next within a month and during the transition from the last day of a month of 31 days to the first day of the following month, a second lever (4) driving a second click (40) constituting said second driving member and cooperating with a correction member (31) of said date mobile (16, 28-31) to shift the date mobile (16, 28-31) in a dragging manner during the transition from the last day of a month of less than 31 days to the first day of the following month until the date mobile (16, 28-31) reaches a position corresponding to the $31^{st}$ before the first click (14) shifts this date mobile (16, 28-31) by one pitch in said instantaneous manner, and means (2) for driving the first and second levers (3, 4).

4. The calendar mechanism according to claim 3, wherein the means for driving the first and second levers comprise another driving member (2) cooperating with respective fingers (9, 10) of the first and second levers (3, 4) to lift progressively, every day, these levers (3, 4) against said first and second return springs (12, 13), and wherein the shifts of the date mobile (16, 28-31) by the second click (40) are effected during the lifting of the second lever (4) and the shifts of the date mobile (16, 28-31) by the first click (14) are effected during a drop of the first lever (3) consecutive to its lifting.

5. The calendar mechanism according to claim 4, wherein the second lever (4) comprises a feeler member (25) which, in a rest position, before the lifting of the second lever (4), is in contact with a months cam (26) or a leap year cam (27) to define a lifting amplitude of the second lever (4) depending on the number of days of the current month, and wherein the drop of the first lever (3) occurs before the drop of the second lever (4), so as to prevent a blocking of the mechanism during the instantaneous shift of the date mobile (16, 28-31) by the first click (14) during the transition from the last day of a month to the first day of the following month.

6. The calendar mechanism according to claim 3, wherein the first and second levers (3, 4) are pivotably mounted about a same axis (5).

7. The calendar mechanism according to claim 3, wherein each one of the first and second levers (3, 4) is designed so that its centre of gravity be substantially on its pivot axis (5).

8. The calendar mechanism according to claim 3, wherein the calendar mechanism further comprises first and second display members (33, 35) which are juxtaposed and respectively bear digits representing the units of the date and digits representing the tens of the date, and wherein these first and second display members (33, 35) are borne respectively by a units pinion (32) and a tens pinion (34) meshing with a units wheel (29) and a tens wheel (30) of the date mobile (16, 28-31).

9. The calendar mechanism according to claim 8, wherein the second click (40) is borne by a shuttle (11) pivotably mounted about the same axis as the tens pinion (34) and comprising a rack (22) engaged with a rack (23) of the second lever (4).

10. The calendar mechanism according to claim 8, wherein the teeth of the units wheel (29) and of the units pinion (32) have an epicycloidal shape, and each tooth of the units wheel (29), when aligned along the imaginary line passing through the respective centres of the units wheel (29) and of the units pinion (32), is centered between two teeth of the units pinion (32).

11. The calendar mechanism according to claim 1, further comprising:

a months pinion (47) bearing a month display member (48), wherein this months pinion (47) is driven by a disk (44) comprising a finger (45) on its periphery and itself driven by a wheel (43) coaxial with the disk (44) through a pin (46) solid with said wheel (43) and located in an aperture (46') of the disk (44), said wheel (43) being itself driven by the date mobile (16, 28-31) via gears (41, 42), and in that the aperture (46') of the disk (44) is of greater size than the pin (46) so that during a correction of the angular position of the months pinion (47) by a manually operated corrector (76), a shift of the disk (44) by the months pinion (47) has no effect on the angular position of said wheel (43).

12. A timepiece comprising a calendar mechanism according to claim 1.

* * * * *